United States Patent [19]

van den Brink

[11] 4,145,804

[45] Mar. 27, 1979

[54] NON-CIRCULAR ORTHOCYCLIC COIL

[75] Inventor: Johan van den Brink, Utrecht, Netherlands

[73] Assignee: U.S. Philips Corporation, New York, N.Y.

[21] Appl. No.: 771,751

[22] Filed: Feb. 24, 1977

[30] Foreign Application Priority Data

Feb. 24, 1976 [NL] Netherlands ..... 7601845

[51] Int. Cl.[2] ..... H01F 41/12

[52] U.S. Cl. ..... 29/605; 29/596

[58] Field of Search ..... 29/605, 596, 598; 336/205, 223, 222

[56] References Cited

U.S. PATENT DOCUMENTS

| | | | |
|---|---|---|---|
| 2,570,786 | 10/1951 | Flynn et al. | 29/605 X |
| 4,048,713 | 9/1977 | Hvass | 29/605 X |

*Primary Examiner*—Carl E. Hall

*Attorney, Agent, or Firm*—David R. Treacy

[57] ABSTRACT

A method of manufacturing an orthocyclic electric coil deviating from a circular shape, and an article made by this method. A circular orthocyclical wire coil is wound with a wire surrounded by an adhesive. The coil is then deformed by bending transversely to the coil axis, during the formation the adhesive being kept soft. After deformation the adhesive is allowed to solidify. The manufactured coil is self-supporting.

12 Claims, 6 Drawing Figures

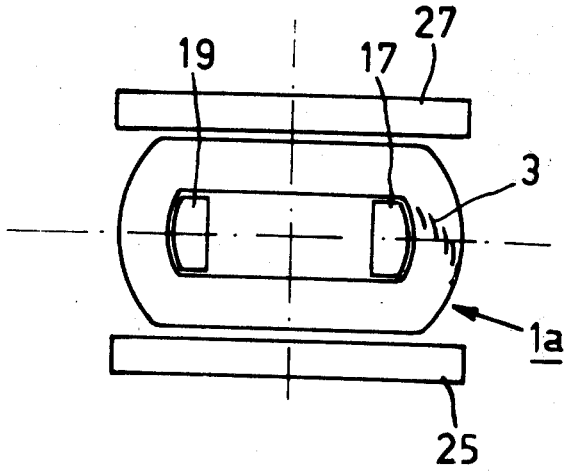

NON-CIRCULAR ORTHOCYCLIC COIL

BACKGROUND OF THE INVENTION

1. Field of the Invention.

The invention relates to a method of manufacturing an electric coil deviating from a circular shape, in which a circular coil is deformed by a bending operation performed transversely to the coil axis, and a coil manufactured by this method.

A circular coil is to be understood to mean herein a coil the turns of which are circular or substantially circular. A coil deviating from a circular shape on the contrary contains turns having, for example, a polygonal, in particular a rectangular, variation from a circle.

2. Description of the Prior Art.

A method known from German Pat. No. 264,676 relates to the manufacture of rectangular coils. Such coils are used for transformers, measuring instruments, and the like. Starting material in this method is a coil which is wound on a circular core and which is compressed to form a rectangular coil by means of a number of members movable transversely to the coil axis. This method requires large forces so as to give the adjoining turns the desired rectangular shape. A drawback of this known method is that the wire is easily damaged during the compression process.

The advantage of a rectangular coiled shape has been sufficiently obvious to those making transformers, ballast coils such as those used for gas discharge lamps, and the like, so that techniques have been developed by which rectangular coil shapes can be wound directly. Known machines drive the bobbin at a constant speed, so that the wire undergoes sharp cyclical variations in tension and undergoes a jerking effect when passing around corners of the bobbin. These problems become particularly significant when it is desired to wind the coil orthocyclically.

Orthocyclically coils, each of whose turns lies in a plane perpendicular to the coil axis except for a short, oblique transition portion between adjacent turns, have the planar portions of each turn of each next outer layer nestled in grooves between the adjacent turns of the preceding layer, as described in U.S. Pat. No. 2,930,014 and in "Philip's Technical Review", Vol. 23, no. 11, pp 365–379 (Oct. 16, 1962). Such coils offer a particularly high space factor and therefore are advantageously used with conventional rectangular lamination stacks.

Techniques for successful winding of orthocyclical coils in a rectangular shape have been developed. When winding an orthocyclic rectangular coil, however, the lengths of the transitions between the turns is not constant, independent of the uniformity of the wire used. Also, known orthocyclic windings have provided all transitions only along one side of the rectangular coil. Further, winding orthocyclical coils in a rectangular shape while using relatively fine wire, such as number 25 AWG or finer, has proved to present great difficulties, when a rectangular shape is desired. Because of the small diameter of the wire it is not possible to wind these fine wire sizes at relatively high speed, because the aforementioned variation in tension and jerking effect tend to destroy the orthocyclical winding.

SUMMARY OF THE INVENTION

The object of the invention is to provide a method of manufacturing a non-circular coil which involves significantly smaller forces on the wire while winding, and hence greatly reduces the possibility of damage.

In a method according to the invention, an orthocyclical circular coil is wound with a wire surrounded by an adhesive material, the adhesive is maintained or brought into a soft condition, the coil is then deformed into a non-circular shape while the adhesive is still soft, and the adhesive is then allowed to solidify.

In a preferred embodiment, the wire is surrounded by an adhesive which has both a soft and a hard state. When the adhesive is soft, during the bending or deforming operation the adhesive behaves as a lubricating agent to permit the turns to slide easily along each other. Relatively small forces are then sufficient to give the coil its desired shape, and as a result wire damage during deformation is prevented. Choice of an adhesive that hardens shortly after completion of the deformation provides the additional advantage that the coil then is rapidly solidified, with its turns rigidly connected together. Thus the formed non-circular coil becomes self-supporting.

In a further preferred embodiment of the method, during the transverse deformation the coil is also deformed by a pressure operation acting along the direction of the coil axis. Also advantageously, the circular coil is oriented before deformation so that the transitions from one layer of turns to a subsequent layer are all positioned in a predetermined location. If the final coil is not to be enclosed along one side, for example by a lamination stack, the transitions are preferably positioned on the non-enclosed side so that the enclosed side can have a constant minimum thickness. Alternatively, in those coils in which the transitions extend over a larger part of the circumference of an initially circular coil, the coils may be oriented so that the transitions are situated on more than one side of the non-circular coil after it has been shaped. This provides the advantage that all the sides can be given the same thickness while a high space factor is nevertheless achieved.

A particular advantage of the method according to the invention is that the deforming operation, being performed while the adhesive is soft, causes a greater part of the adhesive to flow towards the angular cavities between the turns. This produces an increase in density of the coil as viewed in the radial direction, at the same time that the application of axial force will produce an increase in density in the axial direction. The pressure operation is preferably carried out by two members arranged on either side of the coil and moved toward each other while one member serves to support the coil. This method provides the further advantage that the external dimensions of the coil can be closely controlled to a previously determined value, deformation being performed not only by members arranged in the coil aperture and being moved apart, but also by calibrating members acting against the outside of the coil.

According to another aspect of the invention, an orthocyclic coil is provided having a polygonal shape and a particularly high space factor, adhesive material surrounding individual wires being deformed so as substantially to fill the interstices between adjacent coils and layers.

In a further preferred embodiment, transitions between coil layers have a substantially equal length, the transitions being aligned along one or more sides of the coil.

BRIEF DESCRIPTION OF THE DRAWING

The invention will now be described in greater detail with reference to the drawing, in which.

DESCRIPTION OF THE PREFERRED EMBODIMENT.

Figure 1:
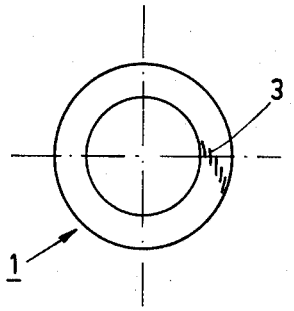
FIG. 1 is an end view of a known circular orthocyclic coil.

FIG. 1 shows the appearance of a circular coil 1 wound orthocyclically in the known manner, viewed toward one of the two end faces of the coil. The transitions 3, each positioned between two successive layers of turns, can clearly be seen in the end face.

Figure 2:
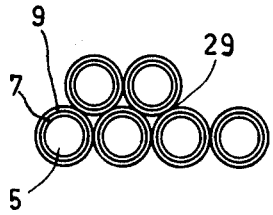
FIG. 2 is a partial cross-sectional view of the coil shown in FIG. 1, FIGS. 3 and 5 show schematically the steps of forming of a rectangular orthocyclic coil according to the invention.

FIG. 2 is a sectional view of a part of the coil 1. After the first layer of turns, the planar portions of the turns are nestled in the grooves between corresponding adjacent turns of a preceding layer. Transitions between layers are aligned in a pre-determined location 3. The coil is preferably formed from so-called "Thermoplac" wire which in this embodiment consists of an aluminum conductor 5, an insulating layer 7 and a layer of adhesive 9 which consists of polyamide. Wire of this generally type is described in Philips Technical Review, vol. 23, no. 11, pages 342–357 (1961/1962). Such a wire has been commonly used for winding circular orthocyclic coils. Alternative wire materials include those having insulation surrounded by a thermosetting adhesive, or an adhesive which contains a solvent maintaining the adhesive in the soft state, adhesive force and hardening being obtained upon evaporation of the solvent.

Figure 3:
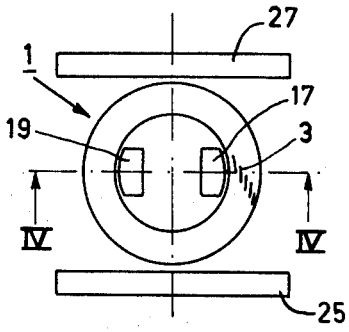
Figure 5:
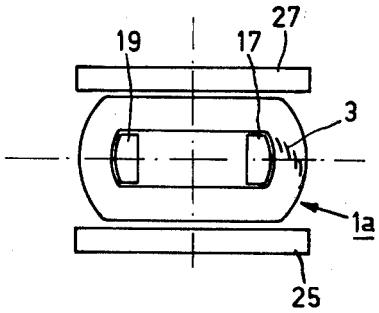
Figure 4:
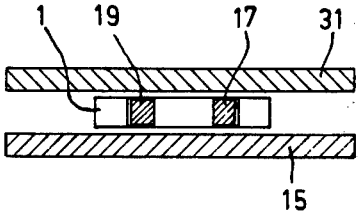
FIG. 4 is a side view partially in cross-section showing application of axial pressure to a coil.

FIGS. 3, 4 and 5 show diagrammatically how such a known circular orthocyclic coil is deformed by the method according to the invention to form a rectangular orthocyclic coil 1*a*. For that purpose the circular coil is placed on a flat support 15 around two bending members 17 and 19 arranged on the support 15. The coil is placed relative to the bending members 17 and 19 in such manner that the location 3 and the inter-turn transitions, after the deformation of the coil, will lie at least mainly on one of the short sides of the rectangular coil. The two bending members 17 and 19 are moved apart in a direction transverse to the axis of the coil by a mechanism of any type well known in the art, the circular orthocyclic coil being deformed to form a rectangular coil 1*a*. Simultaneously with the displacement of the bending members 17 and 19, two calibrating members 25 and 27 arranged on either side of the coil are moved towards each other. To ensure that the adhesive 9 present between the turns is soft before performing the deformation, the coil is heated to a temperature of 140° C. by passing current through it.

During the bending process, the turns slide along each other substantially without friction, with simultaneous displacement of the adhesive 9 towards the interstices 29 between the turns. In order to further increase the density of the coil, a pressure operation in the axial direction is carried out substantialy simultaneously with the bending operation. For that purpose, a pressure plate 31 is arranged above the support 15 between which the coil is compressed in the axial direction by any well-known type of press. The adhesive still present between the turns is forced towards the interstices 29 between the turns. After termination of the mechanical operations, the adhesive is allowed to solidify.

The resulting orthocyclic rectangular coil 1*a* according to the invention is self-supporting. The transitions 3, which had an equal or substantially equal length, are located mainly on one of the short sides of the coil. When a typical lamination core is inserted in such a coil, the transition will preferably lie on the non-enclosed ends, so that the enclosed long sides can have a constant minimum thickness. In an attractive alternative embodiment, inter-layer transitions are provided on opposed short sides of the coil.

Figure 6:
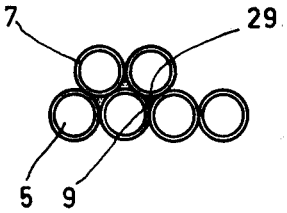
FIG. 6 is a partial cross-sectional view of the coil shown in FIG. 5.

FIG. 6 is a sectional view of a part of the rectangular orthocyclic coil 1*a* according to the invention. The adjacent turns engage each other with their insulation layer 7; the adhesive 9 fills the interstices 29 between the turns.

Many alternative embodiments will be understood by those skilled in the art as falling within the spirit of the invention and the claims. For example, if wire coated with a thermosetting adhesive is used, the coil will be heated during and after deformation until solidification by curing has occurred. Further, heating may be provided by an infrared radiator, a furnace, an induction coil, or any other means known in the art.

When a thermoplastic adhesive is used, it may be advantageous to fix the wire in place after winding, and before transportation to the deforming work station, by heating and cooling. Particularly with coils of fine wire, turns move out of position very easily unless fixed or taped in place.

I claim:

1. A method of manufacturing an electric coil having a non-circular cross-section, comprising winding wire, surrounded by a hardenable adhesive material which is in a soft state, into a circular orthocyclic coil, deforming said coil into a non-circular shape by applying force in two opposite directions transverse to the coil axis while said adhesive material is soft, and while keeping said force below a value which deforms a cross-section of the wire substantially, and after the deforming step allowing the adhesive to harden.

2. A method as claimed in claim 1, comprising in addition the step of deforming the coil by pressure applied in a direction parallel to the coil axis.

3. A method as claimed in claim 1, wherein during said winding step transitions between adjacent turns and transitions between adjacent layers are aligned in a number of predetermined locations, and wherein during said deforming step the coil is so arranged that said predetermined locations lie along at least one of two opposite sides of the coil.

4. A method as claimed in claim 1 wherein said circular orthocyclic coil has an aperture, comprising in addition the step of inserting two bending members into said aperture, and wherein said deforming steps comprises applying force to move said members in opposite directions transverse to said axis.

5. A method as claimed in claim 4 comprising in addition advancing two calibrating members toward opposite sides of the coil in directions transverse to said opposite directions and said axis, and applying force to said calibrating members to deform opposed outside surfaces of the coil.

6. A method of manufacturing an electric coil having a non-circular cross-section, from wire surrounded by an adhesive material which has both a soft state and a hardened state, comprising winding said wire, while in the hardened state, into a circular orthocyclic coil, then bringing said adhesive material into said soft state, deforming said coil into a non-circular shape by applying force in two opposite directions transverse to the coil axis while said adhesive material is soft, and while keeping said force below a value which deforms a cross-section of the wire substantially, and after the deforming step allowing the adhesive to harden.

7. A method as claimed in claim 6, comprising in addition the step of deforming the coil by pressure applied in a direction parallel to the coil axis.

8. A method as claimed in claim 7 wherein said force is applied to cause the adhesive material to flow into and substantially fill interstices between the turns.

9. A method as claimed in claim 7, wherein said force is applied to cause the adhesive material to flow into and substantially fill interstices between the turns.

10. A method as claimed in claim 6, wherein during said winding step transitions between adjacent turns and transitions between adjacent layers are aligned in a number of predetermined locations, and wherein during said deforming step the coil is so arranged that said predetermined locations lie along at least one of two opposite sides of the coil.

11. A method as claimed in claim 6, wherein said circular orthocyclic coil has an aperture, comprising in addition the step of inserting two bending members into said aperture, and wherein said deforming step comprises applying force to move said members in opposite directions transverse to said axis.

12. A method as claimed in claim 11, comprising in addition advancing two calibrating members toward opposite sides of the coil in directions transverse to said opposite directions and said axis, and applying force to said calibrating members to deform opposed outside surfaces of the coil.

* * * * *